US010773225B2

(12) United States Patent
Reuter

(10) Patent No.: US 10,773,225 B2
(45) Date of Patent: Sep. 15, 2020

(54) APPARATUS AND METHOD FOR MIXING COMPONENTS

(71) Applicant: Marco Systemanalyse und Entwicklung GmbH, Dachau (DE)

(72) Inventor: Martin Reuter, Dachau (DE)

(73) Assignee: Marco Systemanalyse und Entwicklung GmbH (DE)

( * ) Notice: Subject to any disclaimer, the term of this patent is extended or adjusted under 35 U.S.C. 154(b) by 380 days.

(21) Appl. No.: 15/499,271

(22) Filed: Apr. 27, 2017

(65) Prior Publication Data

US 2017/0312710 A1 Nov. 2, 2017

(30) Foreign Application Priority Data

May 2, 2016 (DE) ..... 10 2016 108 108

(51) Int. Cl.
*B01F 11/00* (2006.01)
*B01F 15/02* (2006.01)
*B01F 15/00* (2006.01)

(52) U.S. Cl.
CPC .... *B01F 11/0088* (2013.01); *B01F 15/00876* (2013.01); *B01F 15/026* (2013.01); *B01F 2215/0422* (2013.01); *B01F 2215/0431* (2013.01)

(58) Field of Classification Search
CPC ..... B01F 11/0088; B01F 15/00876; B01F 7/169; B01F 7/1675; B65D 25/08; G01F 11/20; G01F 11/22; G01F 11/24; Y10T 137/7904; F16K 31/045
USPC ..... 366/154.1; 251/287
See application file for complete search history.

(56) References Cited

U.S. PATENT DOCUMENTS

| | | | | |
|---|---|---|---|---|
| 3,333,601 A * | 8/1967 | Lofgreen | ..... | G05D 11/006 137/636.1 |
| 6,202,600 B1 | 3/2001 | Miceli | | |
| 2010/0149905 A1* | 6/2010 | Fily | ..... | B01F 11/0088 366/130 |
| 2015/0037305 A1 | 2/2015 | Cordisco | | |

FOREIGN PATENT DOCUMENTS

| | | | |
|---|---|---|---|
| DE | 1134969 | B | 8/1962 |
| EP | 1669131 | A1 | 6/2006 |
| EP | 2349549 | B1 | 7/2012 |
| JP | 3617792 | B | 1/2001 |
| JP | 2001240601 | A | 9/2001 |
| JP | 4643746 | B | 4/2010 |
| JP | 2013537468 | A | 10/2013 |
| WO | 2016086962 | A1 | 6/2016 |

OTHER PUBLICATIONS

Official Communication from the Patent Offfice in Japan for related JP Application No. 2017084923; 3 pages.
Official Communication from German Patent Office for German Application No. DE102016108108.6; dated Feb. 1, 2017; 10 pages.

* cited by examiner

*Primary Examiner* — Elizabeth Insler
(74) *Attorney, Agent, or Firm* — Dickinson Wright PLLC

(57) ABSTRACT

A dynamic mixer comprises a mixing chamber having a plurality of inlets and an outlet as well as a mixing element rotatably arranged in the mixing chamber. The mixing takes place by a to and fro movement of the mixing element.

20 Claims, 1 Drawing Sheet

APPARATUS AND METHOD FOR MIXING COMPONENTS

CROSS REFERENCE TO RELATED APPLICATIONS

Figure 1:
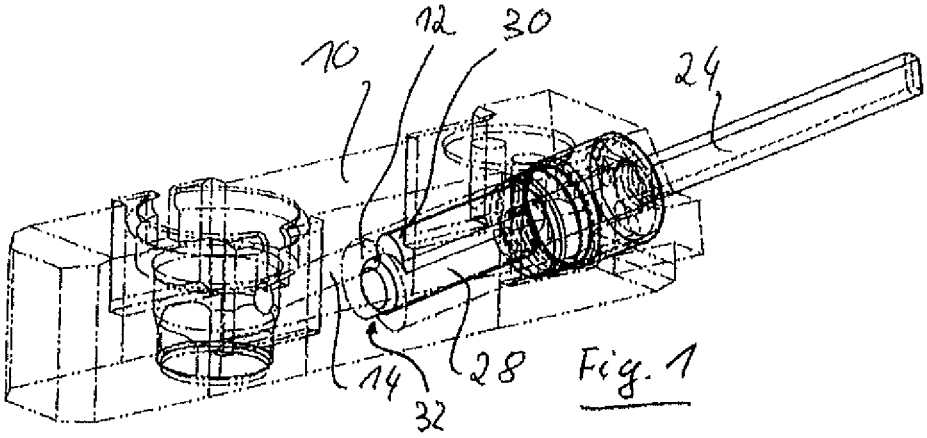

This claims priority to DE102016108108.6 filed May 2, 2016, which is hereby incorporated by reference in its entirety.

The present invention relates to an apparatus and to a method for mixing components and in particular to a dynamic mixer having a mixing chamber that has at least one first and one second inlet as well as an outlet, wherein a mixing element is rotatably arranged in the mixing chamber.

Known dynamic mixers of this kind have the disadvantage that the rotor separates the space in the mixing chamber such that there is a volume swept through by the rotor and a volume not swept through by the rotor within the mixing chamber. Sections are hereby created both in the region of the rotor and in the region of the mixing chamber that are not flowed through sufficiently, i.e. the medium comprising the components to be mixed is either moved too slowly at the wall of the mixing chamber due to the braking or, however, the medium is also rotated by the rotor—in particular also close to a shaft of the rotor—such that the medium only has a very low relative speed with respect to the rotor and the rotor shaft. Material can then accumulate in these regions, which in particular hardens too fast on the mixing of multicomponent adhesives.

It is the object of the present invention to improve a dynamic mixer such that in particular fast-hardening components can be intermixed in an improved manner in small volumes.

This object is satisfied by the features of claim 1 and in particular in that at least one abutment is provided in the dynamic mixer that is in particular arranged in the mixing chamber and that prevents a rotation of the mixing element by 360°.

In accordance with the invention, the intermixing in the mixing chamber thus does not take place by a continuous rotation by more than 360°, but rather by an enforced to and fro movement. If the abutment is provided in the mixing chamber in this context, the mixing element has to be moved against the abutment or at least toward the abutment during the to and fro movement such that the medium to be mixed is urged in the direction of the abutment, wherein the components to be mixed are blended with one another. It is necessary due to the provision of the abutment that, unlike conventional dynamic mixers, the mixing element is not moved with a continuous axial rotation in the same direction, but rather that the direction of rotation changes continuously, which promotes a good intermixing.

Advantageous embodiments of the present invention are described in the description, in the drawing and in the dependent claims.

The mixing element can be completely closed, i.e. can be configured without interruptions or openings, in a first advantageous embodiment such that it divides the mixing chamber into two mutually separate part chambers, viewed in cross-section, when it is not in one of its end positions. Two part chambers are hereby formed on each movement of the mixing element that vary their size continuously, whereby the medium can cross over from one part chamber into the other part chamber to mix. When the mixing element is in one of its end positions, one of the two part chambers is no longer present since the medium to be intermixed has been completely conveyed into the other part chamber.

In accordance with a further advantageous embodiment, the mixing element can have a shaft and at least one wiping vane arranged thereat. The components of the medium to be blended can be continuously wiped off the wall of the mixing chamber by such a wiping vane such that the free volume of the mixing chamber is cyclically wiped off.

It can be advantageous in this respect if a radial gap that extends in the axial direction and through which the medium can flow and can thereby intermix on a movement of the mixing element is provided between a radially outer end of the mixing element and a wall of the mixing chamber. The radial gap can in particular extend over the total length of the mixing chamber or over almost the total length of the mixing chamber.

In accordance with a further advantageous embodiment, a radial gap that extends in the axial direction and that in particular extends over the total length or over almost the total length of the mixing chamber can additionally or alternatively be provided between a shaft of the mixing element and a wall of the mixing chamber. Medium can hereby also be urged through this radial gap when the mixing element is rotated in the direction of the abutment.

In accordance with a further advantageous embodiment, the mixing element can at least partly not extend over the total axial length of the mixing chamber, but in particular only over approximately 85% to 99% of the length of the mixing chamber. It is ensured by this measure that the intermixed medium is no longer moved to and fro at the end of the mixing chamber and that the outlet is always open such that no appreciable pressure fluctuations occur at the outlet of the mixer.

In accordance with a further advantageous embodiment, a wiping vane of the mixing element can areally contact the abutment, in particular over its total area, at least in one end position of the mixing element. It is provided in this manner that the medium is displaced over a large area by the approaching surfaces of the wiping vane and of the abutment on an approach of the wiping vane toward the abutment, which promotes an intimate intermixing.

The wiping vane can be configured in the manner of a key bit and can have interruptions. The wiping vane can thus be formed from two or more part sections or can have openings or the like.

In accordance with a further advantageous embodiment, the mixing chamber can have, viewed in cross-section, a cross-section differing from the circular shape or the part-circle shape over a part section of its periphery, and in particular over its total axial length. The abutment provided in accordance with the invention can hereby be formed by the wall of the mixing chamber in that the latter has an asymmetrical and inwardly projecting cross-sectional shape. The abutment can in particular extend almost up to the mixing element such that the mixing chamber can be divided into two part chambers (except for a radial gap) by the abutment.

The mixing chamber can have a radius, viewed in cross-section, i.e. in a section perpendicular to the axis of rotation of the mixing element, that decreases from a maximum radius down to a minimal radius over a part section of the periphery of the mixing chamber, and in particular also over its total axial length, and then increases in size again up to the maximum radius. A wavy elevated portion that provides a good intermixing of the components in cooperation with the mixing element is hereby integrated into the mixing chamber that is circular or that is cylindrical in volume in cross-section. In a geometric aspect, the mixing chamber can have a peripheral contour, viewed in cross-section, i.e. in a section perpendicular to the axis of rotation of the mixing element, that is continuous (in a mathematical sense) and that has two inflection points. Provision is still made in this manner that no edges remain within the mixing chamber in which unmixed medium could accumulate. An abutment is nevertheless present which extends in the longitudinal direction through the mixing chamber and which the mixing element or the wiping vane can abut.

The mixer in accordance with the invention is particularly suitable for very quickly hardening components, for example two-component adhesives having a hardening time in the order of a few minutes, since the volume of the mixing chamber can be selected as extremely small, for example in an order of less than 20 $mm^3$, in particular of less than 10 $mm^3$, for example 7 $mm^3$. For this reason, the mixer in accordance with the invention can also be advantageously integrated in a metering valve, and indeed such that the volume of the mixing chamber and the volume of a media channel from the outlet of the mixing chamber up to a valve seat of the metering valve takes up a volume of less than 350 $mm^3$, in particular of less than 300 $mm^3$, for example approximately 290 $mm^3$.

In accordance with a further aspect of the present invention, it relates to a method for mixing two components, in particular two-component fluids, having very small hardening times. In the method, that can in particular be carried out using a mixer of the above-named kind, the two components are introduced into a mixing chamber and are mixed in the mixing chamber by a rotatable mixing element, and indeed such that the mixing element is respectively moved to and fro in the mixing chamber up to an abutment provided in the mixing chamber. It can be particularly advantageous in this respect if the two components of the medium are urged with the aid of the mixing element on every to and fro movement in opposite directions through at least one radial gap that is provided between the mixing chamber and the mixing element. The medium is preferably urged through two radial gaps when the mixing element is moved to and fro.

Figure 2:
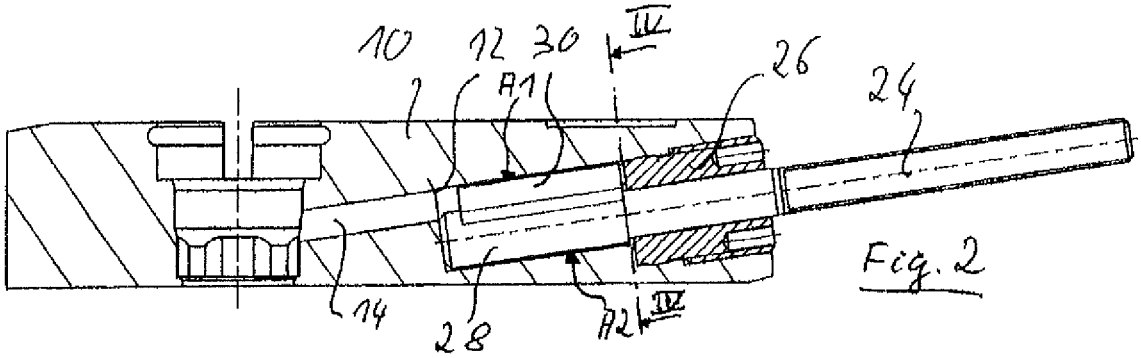
Figure 3:
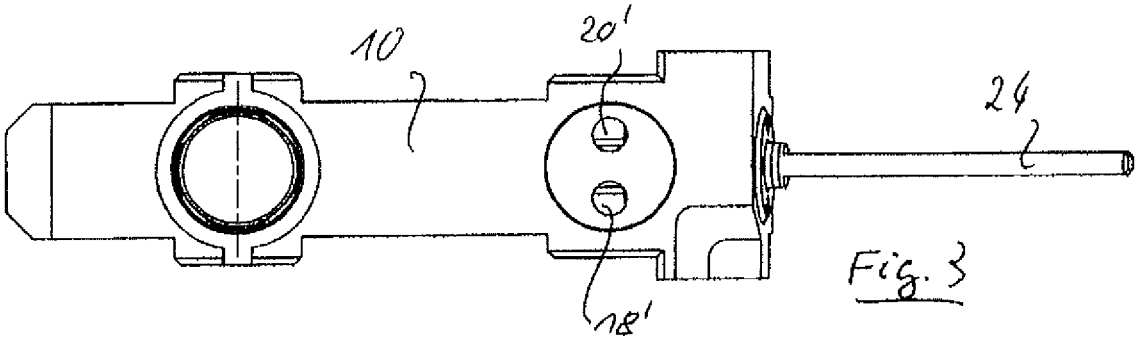
Figure 4:
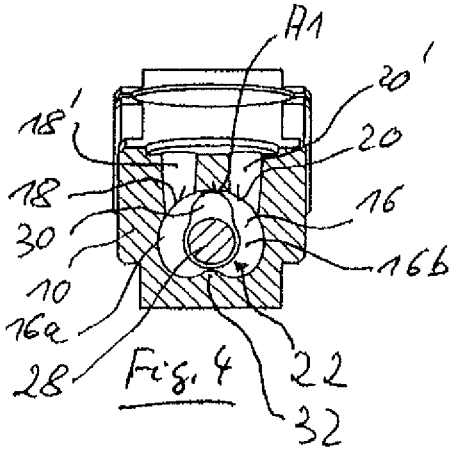

The present invention will be described in the following purely by way of example with reference to an advantageous embodiment and to the enclosed drawings. There are shown:

FIG. 1 a perspective view through a dynamic mixer that is integrated into a housing of a metering valve;

FIG. 2 a longitudinal section through the arrangement of FIG. 1;

FIG. 3 a plan view of the arrangement of FIG. 1;

FIG. 4 a section along the line IV-IV of FIG. 2; and

Figure 5:
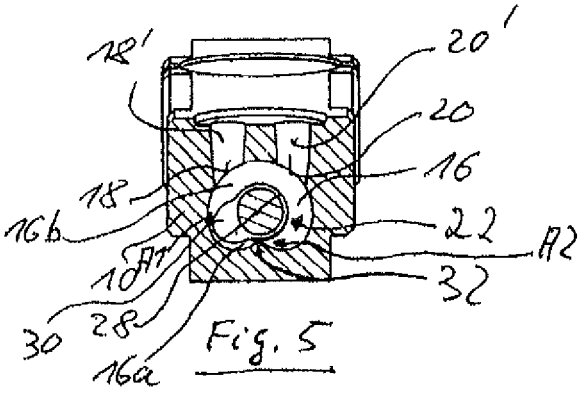

FIG. 5 a sectional view comparable with FIG. 4, but with the mixing element having been rotated counter-clockwise in the direction of the abutment.

FIG. 1 shows a housing 10 of a metering valve that is not shown in any more detail and that is integrated into a dynamic mixer whose outlet 12 is in communication with the metering valve (not shown) via a media channel 14. The housing 10 of the metering valve thus also forms the housing of the dynamic mixer and a mixing chamber 16 whose cross-section can be easily recognized in FIGS. 4 and 5 is provided in the housing 10. The mixing chamber 16 has a first inlet 18 and a second inlet 20 into which inlets a first inlet passage 18' and a second inlet passage 20' open for supplying two fluid components of the medium to be mixed. It is understood that more than two inlets or also more than one outlet can also be provided.

A mixing element 22 that is rotatable in the mixing chamber via a shaft 24 that is guided in a socket 26 screwed in the housing 10 is provided in the mixing chamber 16 for an intimate blending of the components to be mixed in a small volume and in a short time.

The mixing element 22 comprises a cylindrical shaft section 28 that has a somewhat smaller diameter than a shaft section of the shaft 24 located in the socket 26 and that extends over the total length of the mixing chamber 16. A wiping vane 30 is molded at or fastened to the outer periphery of the shaft section 28; it extends over approximately 90% of the axial length of the mixing chamber 16 and its radially outer end forms a radial gap A1 extending in the axial direction with the wall of the mixing chamber (16).

The wiping vane 30 in the embodiment shown is continuous in the longitudinal direction, i.e. it is not interrupted, and it is connected to the shaft section 28 such hat no sharp edges are formed. The wiping vane 30 has a uniformly convexly curved surface at its radially outer jacket surface such that the medium can flow evenly through the radial gap A1.

The cross-sectional views of FIGS. 4 and 5 illustrate that the mixing chamber 16 is not circularly symmetrical, but rather has, viewed in cross-section, a cross-section differing from the circular shape over a part section of its periphery (at the bottom in the Figures) over its total axial length in the embodiment shown (cf. FIG. 2). In more precise terms, the mixing chamber 16 has, viewed in cross-section, a radius (whose center is intersected in a perpendicular manner by the axis of rotation of the shaft 24) that reduces from a maximum radius down to a minimal radius over a part section of the periphery of the mixing chamber and over its total axial length and then increases in size again up to the maximum radius, with the part section of the periphery extending over approximately 90°. The mixing chamber 16 thus has, viewed in cross-section, a peripheral contour or a surface line that is continuous in the geometrical sense and that has two inflection points, whereby an abutment 32 is formed within the mixing chamber 16 that is integrated into the wall of the mixing chamber and that prevents a rotation of the mixing element 22 by a complete 360°. In this respect, a second radial gap A2 is formed between the abutment 32 and the shaft section 28 of the mixing element 22 (cf. FIG. 2 and FIG. 5); it extends in the axial direction and the wiping vane 30 can urge medium through it when the mixing element 22 moves to and fro.

As FIGS. 4 and 5 illustrate, the mixing element 22 divides the mixing chamber 16, viewed in cross-section, into two mutually separate part chambers 16*a* and 16*b* when the mixing element 22 is not in one of its two end positions. In this respect, the volume of the two part chambers 16*a* and 16*b* is the same when the mixing element 22 is in the middle position shown in FIG. 4. At the same time, the volume of the respective part chamber can be reduced to zero or almost zero when the mixing element 22 is in one of its two end positions. In this end position, the wiping vane 30 of the mixing element 22 contacts the abutment 32 areally and over the total axial length of the wiping vane 30 such that the medium that was previously located in the part chamber 16*a* (or 16*b*) has been completely urged through the radial gap A2 into the respective other part chamber. If therefore, for example, the mixing element 22 is in its left end position (it is close to that position shown in FIG. 5) and if the mixing element is subsequently rotated clockwise, the medium located in the maximized part chamber 16*b* is urged both through the radial gap A1 and through the radial gap A2 into the opening chamber 16*a* and is mixed in so doing.

A method for mixing two components can be carried out using the above-described dynamic mixer in which a first component and a second component are introduced through the inlet channels 18' and 20' into the inlet 18 and the inlet 20 of the mixing chamber 16 in that the components are pressurized. The two components are then mixed in the mixing chamber 16 by the rotatable mixing element 22 in that the mixing element 22 is respectively moved to and fro up to the abutment 32 provided in the chamber 16. The two components introduced into the mixing chamber 16 or the medium located in the mixing chamber 16 are urged with the aid of the mixing element on each to and fro movement of the mixing element 22 in opposite directions through the first radial gap A1 and through the second radial gap A2 that is respectively provided between the mixing chamber and the mixing element. The to and fro movement of the mixing element 22 takes place in this respect in the embodiment shown over approximately 270°, i.e. the direction of rotation of the mixing element is constantly changed.

On a use of a divided mixing element or of a mixing element having interruptions, a greater turbulence can provide a greater intermixing, whereas the embodiment shown having a continuous wiping vane provides a particularly uniform wiping of the medium.

The drive of the mixing element can take place by a stepper motor with which the movement of the mixing element can be controlled very exactly with a changing direction of rotation. A recognition of the abutting or also of the approach to or toward the abutment can be recognized by the detection of the power consumption of the motor. It can hereby simultaneously be recognized if already hardened material has accumulated at the abutment at the housing wall. Such an increase namely produces a reduced angle of rotation that can be detected, in particular by the control of the motor. The zero position of the mixing element can furthermore be simply traveled to by the abutment. For this purpose, the motor is either moved on by a defined number of steps that is larger by at least one step than the maximum angle of rotation of the mixing element or the motor is traveled so far until an abutment is recognized with reference to the power load.

Alternatively, a simple electric motor can also be used for the drive and/or a distance sensor can be used that recognizes the end position or the abutment of the mixing element or measures the rotational movement of the rotor axis.

The above-described dynamic mixer is very well-suited for very small mixing volumes and only amounts to approximately 7 $mm^3$ in the embodiment shown, which amounts to a little less than 4% of the mixing volume of static mixers. The volume of the mixed medium from the inlet up to a valve seat of the metering valve (including the media channel 14) can also be kept extremely small, for example below 300 $mm^3$.

The invention claimed is:

1. A dynamic mixer, comprising a mixing chamber having at least one first inlet and one second inlet and an outlet;

a mixing element rotatably arranged about an axis of rotation in the mixing chamber, and at least one abutment that prevents a rotation of the mixing element by 360°, the dynamic mixer is integrated in a metering valve; and the volume of the mixing chamber and of a media channel from the outlet up to a valve seat of the metering valve has a volume of less than 350 $mm^3$.

2. The mixer in accordance with claim 1, wherein the at least one abutment is arranged in the mixing chamber.

3. The mixer in accordance with claim 1, wherein the mixing element divides the mixing chamber, viewed in cross-section, into two mutually separate part chambers when it is not in one of its end positions.

4. The mixer in accordance with claim 1, further comprising a first radial gap that is provided between a radially outer end of the mixing element and a wall of the mixing chamber.

5. The mixer in accordance with claim 4, wherein the first radial gap extends in an axial direction.

6. The mixer in accordance with claim 1, further comprising a second radial gap that is provided between a shaft section of the mixing element and a wall of the mixing chamber.

7. The mixer in accordance with claim 6, wherein the second radial gap extends in an axial direction.

8. The mixer in accordance with claim 1, wherein the mixing element has a shaft section and at least one wiping vane arranged thereat.

9. The mixer in accordance with claim 8, wherein the wiping vane does not extend over a total axial length of the mixing chamber.

10. The mixer in accordance with claim 9, wherein the at least one wiping vane extends only over approximately 85%-99% of the length of the mixing chamber.

11. The mixer in accordance with claim 8, wherein the at least one wiping vane contacts the at least one abutment areally at least in an end position of the mixing element.

12. The mixer in accordance with claim 8, wherein the at least one wiping vane is partly interrupted.

13. The mixer in accordance with claim 1, wherein the mixing chamber has, viewed in cross-section, a cross-section differing from a circular shape over a part section of a periphery of the mixing chamber.

14. The mixer in accordance with claim 13, wherein the cross-section of the mixing chamber, viewed in cross-section, differs from the circular shape over a total axial length of the mixing chamber.

15. The mixer in accordance with claim 1, wherein the mixing chamber has a radius, viewed in cross-section, the cross-section being a section perpendicular to the axis of rotation, that decreases from a maximum radius down to a minimal radius over a part section of the periphery of the mixing chamber and then increases in size again up to the maximum radius.

16. The mixer in accordance with claim 15, wherein the radius that decreases from a maximum radius down to a minimal radius over a part section of the periphery of the mixing chamber decreases over a total axial length of the mixing chamber and then increases in size again up to the maximum radius.

17. The mixer in accordance with claim 1, wherein the mixing chamber has, viewed in cross-section, the cross-section being a section perpendicular to the axis of rotation, a peripheral contour that is continuous in the mathematical sense and that has two inflection points.

18. The mixer in accordance with claim 1, wherein the mixing chamber has a volume of less than 20 $mm^3$.

19. The mixer in accordance with claim 1, wherein the mixing element is contained within the entire volume of the mixing chamber.

20. A dynamic mixer, comprising:

a mixing chamber having at least one first inlet and one second inlet and an outlet;

a mixing element rotatably arranged about an axis of rotation in the mixing chamber, at least one abutment that prevents a rotation of the mixing element by 360°, the dynamic mixer is integrated in a metering valve; and the volume of the mixing chamber and of a media channel from the outlet up to a valve seat of the metering valve has a volume of less than 350 $mm^3$, and an electric motor configured to drive the mixing element rotatably about the axis of rotation in the mixing chamber.

* * * * *